United States Patent [19]

Lasko

[11] Patent Number: 4,763,593

[45] Date of Patent: Aug. 16, 1988

[54] SMALL BOAT DRY DOCK

[76] Inventor: George A. Lasko, 59 Antigua Ct., Coronado, Calif. 92118

[21] Appl. No.: 925,791

[22] Filed: Oct. 31, 1986

[51] Int. Cl.[4] ..... B63C 9/22

[52] U.S. Cl. ..... 114/44; 114/373; 114/376

[58] Field of Search ..... 114/44, 48, 258, 263, 114/365, 366, 368-374, 377; 405/1, 3, 4

[56] References Cited

U.S. PATENT DOCUMENTS

| | | | |
|---|---|---|---|
| 2,356,539 | 8/1944 | Schroder-Nielsen | 114/376 |
| 2,473,557 | 6/1949 | Woodruff | 114/373 |
| 2,815,131 | 12/1957 | Lunsman et al. | 114/373 |
| 3,143,991 | 8/1964 | Anderson | 114/365 |
| 3,942,655 | 3/1976 | Andersen | 114/373 |
| 4,157,596 | 6/1979 | Green | 114/365 |

FOREIGN PATENT DOCUMENTS

| | | | |
|---|---|---|---|
| 9249 | 12/1920 | Netherlands | 114/370 |

*Primary Examiner*—Joseph F. Peters, Jr.
*Assistant Examiner*—Stephen P. Avila
*Attorney, Agent, or Firm*—William F. Frank

[57] ABSTRACT

A mechanical device for lifting, storing and launching small boats in and out of the water along side conventional dry docks.

7 Claims, 3 Drawing Sheets

FIG. 1
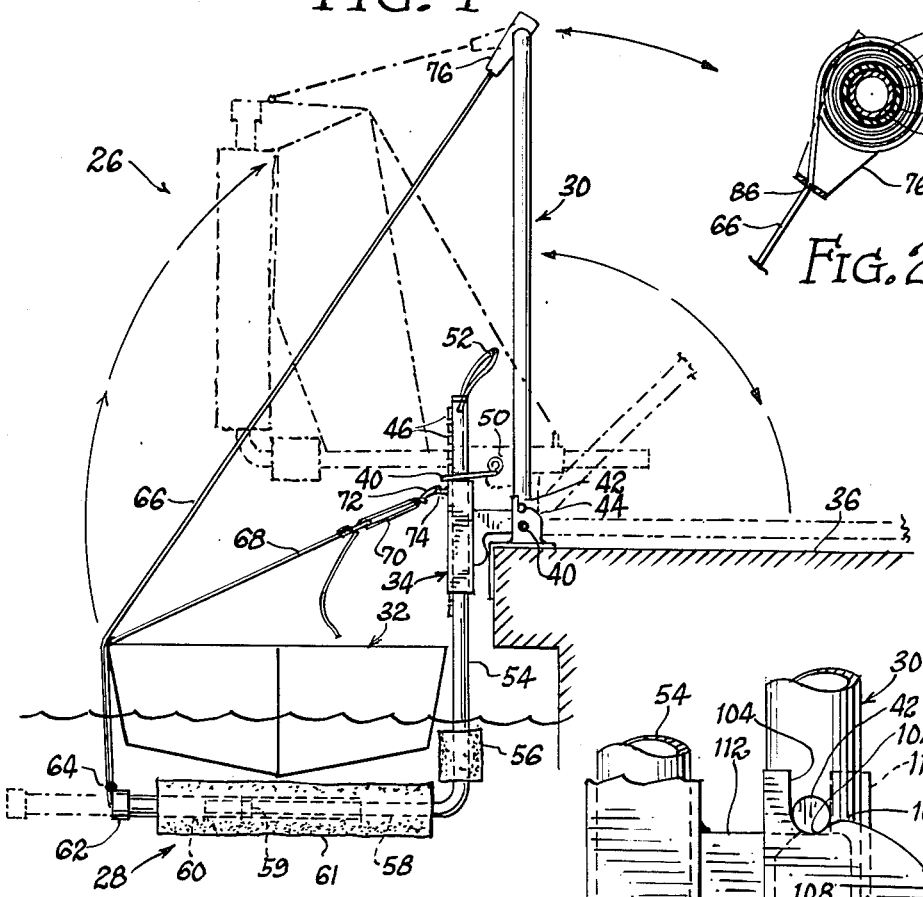
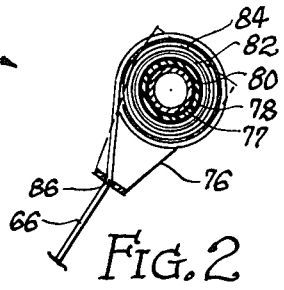
FIG. 2
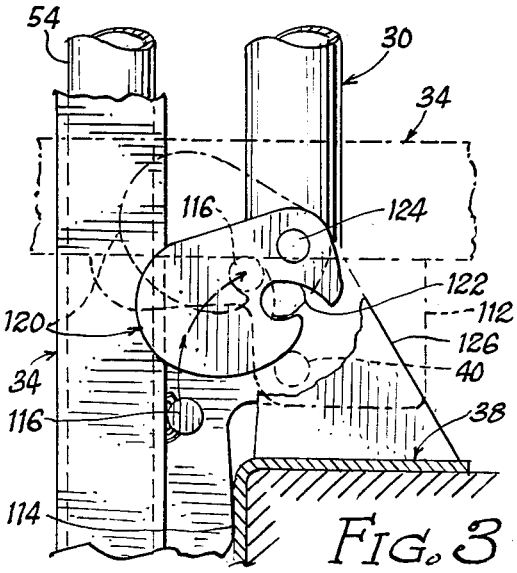
FIG. 3
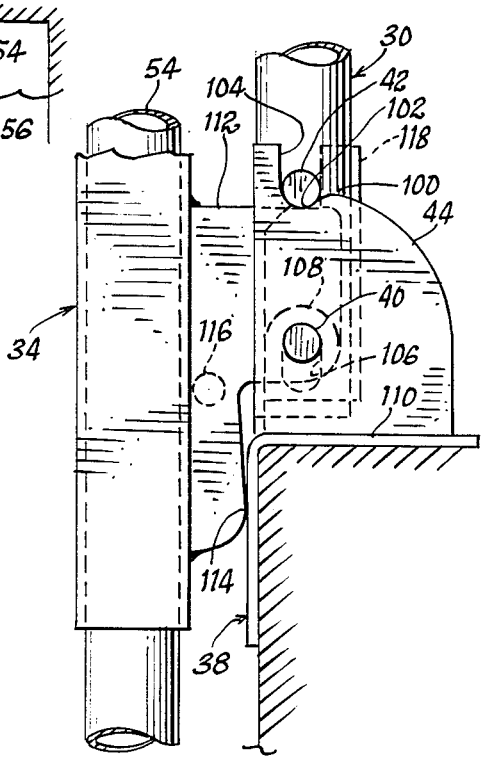
FIG. 4

FIG. 5
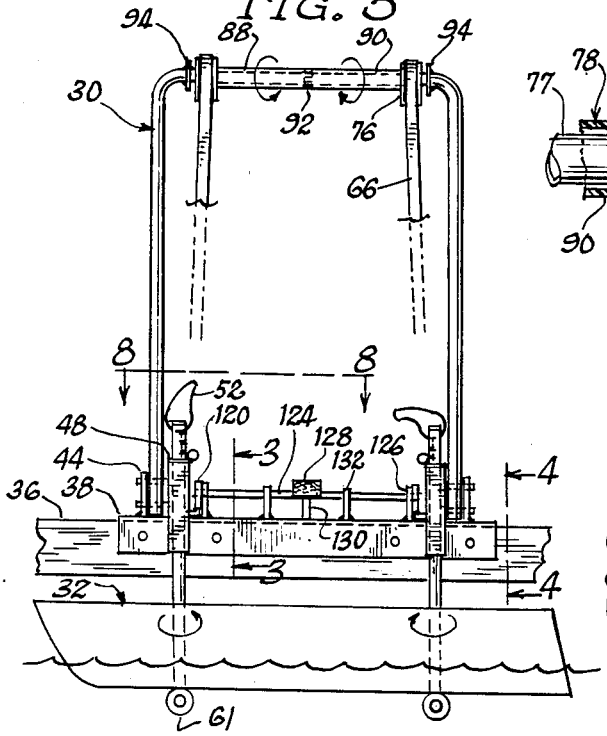
FIG. 6
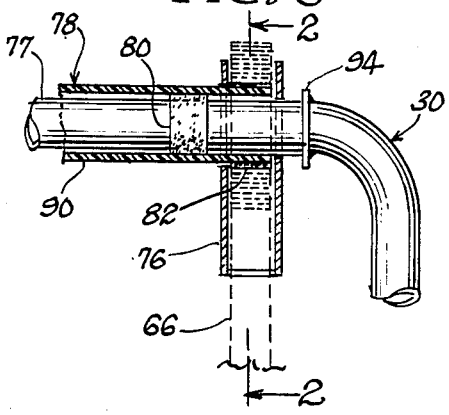
FIG. 7
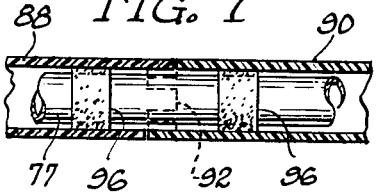
FIG. 8
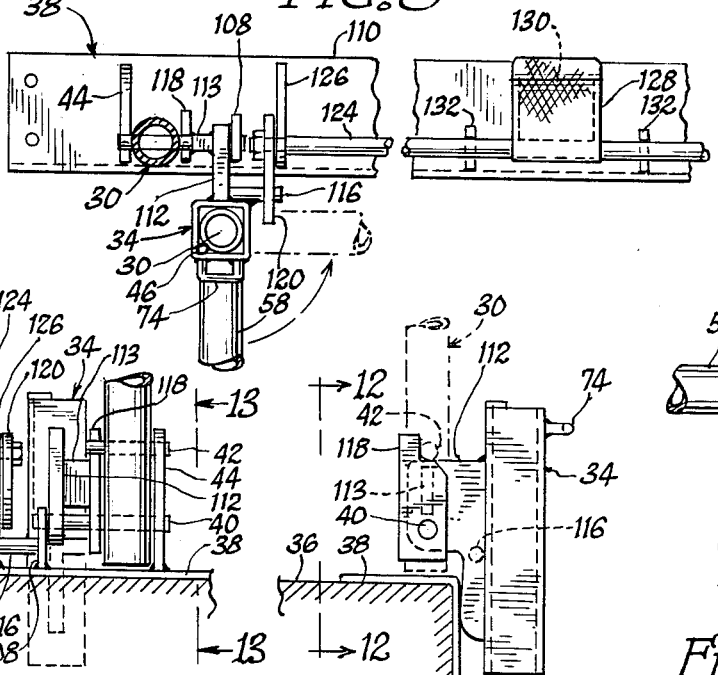
FIG. 9
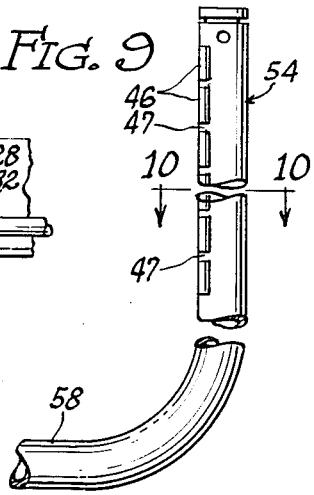
FIG. 10
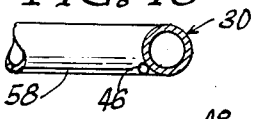
FIG. 11
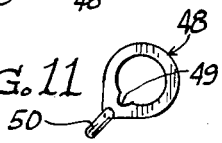
FIG. 12
FIG. 13

SMALL BOAT DRY DOCK

BACKGROUND OF INVENTION

Both commercial and private small boats are best stored out of the water when not in use. Without my invention it is too time consuming and awkward to get boats in and out of the water. Leaving them in the water takes up needed space; it subjects boats to rot, marine organisms and algae growth. Frequent cleaning is necessary. Also, uncovered boats retain rain water to exacerbate problems. Also to store boats on dry docks create space problems. So much that so many yacht clubs and marinas have rules which forbid the practice. It interferes with foot traffic, especially in emergency situations. Regardless of rules, it is often too troublesome and burdensome to take boats in and out of the water. There has been great need for both getting boats in and out of water easily and in avoiding the use of valuable space on the dock.

Heretofore no one has provided a device which combines all desirable features in connection with the moving and storing of boats regardless of the size and configuration of the boat hulls.

SUMMARY OF THE INVENTION

My novel device has components which function in multiple modes. Thus a fulcrum secured to the edge of a conventional dock is positioned between integrated lever arms; one arm functions as a retaining means for both moving the boat and for storing it, while the opposite arm functions as a lever arm for both raising and then lowering the boat and also for cradling it for storage. Adjusting means for accommodating strap or rope retainers around variously shaped and sized hulls is another feature of the invention. Also, the lever arm for raising or lowering the boat may be set to operate regardless of how far below the dock the water may be. Other features will appear in the following specifications.

DESCRIPTION OF DRAWINGS

In the accompanying drawings:

FIG. 1 is an elevation view from one end showing a boat ready for lifting out of the water by the device and a phantom view of the boat when docked.

FIG. 2 is a cross sectional view of bar-reel taken along line 2—2 of FIG. 6.

FIG. 3 is detail of latch means taken along line 3—3 of FIG. 5.

FIG. 4 is a detail of the fulcrum portion of device taken from edge thereof when the boat is in the water. The area is encompassed by line 4—4 of FIG. 5.

FIG. 5 is an elevation view of device taken the from water side thereof.

FIG. 6 is sectional detail of the handle portion showing reel and friction means.

FIG. 7 is sectional detail of the central portion of handle portion showing friction means and split of handle into dual segments.

FIG. 8 is a top view of fulcrum portion of device taken along line 8—8 of FIG. 5.

FIG. 9 is a detail of the angled section of the lever arm on which a boat rests.

FIG. 10 is a detail of the angled section taken along line 10—10 of FIG. 9.

FIG. 11 is a cross-sectional detail of the locking ring arrangement also seen in FIG. 21.

FIG. 12 is a detail of the fulcrum and latching areas taken along line 12—12 of FIG. 13.

FIG. 13 is a detail of such area taken along line 13—13 of FIG. 12.

SUMMARY OF PREFERRED EMBODIMENT

Figure 14:
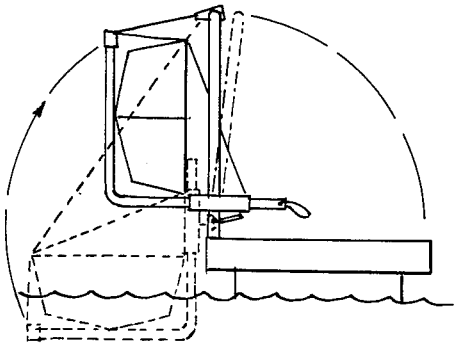
FIG. 14 is elevation view from end showing outline of major parts of invention with boat out of water and phantom outline of boat and device when boat is in the water.
Figure 15:
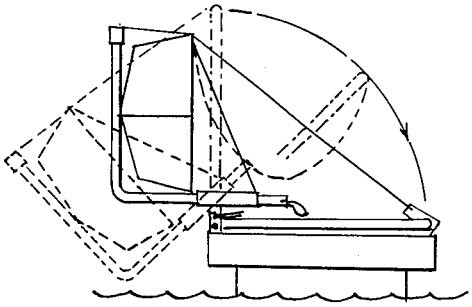
FIG. 15 is same view as preceding one, except device containing boat is shown, by phantom view, between docking and water.

In the drawings a lever member, depicted as item 30, is preferably of inverted U-shape construction. It functions, alternately, as a lever for raising a boat from the water and then later as a part of a cradle for holding it on the dry dock. This member has dual elongated orifices 106 near the open end of each arm. Above each orifice or slot is a fulcrum pin. An abutting pin 42 protrudes, from each side of each arm, transversely, whereby it is at right angles to the arm and parallel to conventional dock 36 and the transverse section 77 of the lever member.

A base member is provided for securing all components to a conventional dock 36. It is preferably a right angled metal plate suitable for securing with bolts along the edge of the dock whereby one surface is on the floor of the dock and the other surface is along the edge of the dock. See item 110 and items 38, respectively in FIG. 4.

Because the remaining described parts are, except as specified, present in like pairs, for convenience, reference to only single parts will be made. The illustrations show the dual nature of the parts.

Between the lever member and base member is an outer mounting bracket 44. This bracket is similarly of right angled construction. One surface of the bracket is secured to the base member, one at each end thereof. The other surface of the bracket projects vertically from the dock. An orifice is provided in each vertical portion. Integral with such exterior mounting bracket is a stop of abutting surface 104. Such formation appears at the upper end of the bracket as an extension thereof. See FIG. 13. That portion not so extended is rounded and has a slight rise 100. The outwardly extending section of pin 42 abuts the stop as section in a slight recess along the upper edge of the bracket.

Similarly secured to the base member is an inner mounting bracket 108. Unlike its outer counterpart, this inner bracket has a single function. It is provided with an orifice aligned with an orifice in its corresponding outer mounting bracket. These retain fulcrum shaft portion 40. On such shaft portion a leg of the first described lever member is pivotally mounted. The shaft portion passes through elongated slot 106 of the leg.

Also rotatably mounted on each section of the shaft portion 40 is an integrated carrier member. See FIG. 8. Such novel member is an important part of the invention. It is an integrated collar portion, a sleeve sector disposed at right angles thereto and a boss portion integrated therewith. More particularly, a collar portion 113, of cylindrical configuration circumvents the shaft portion. See FIG. 12. Thus, it is horizontally disposed. Integral therewith is a sleeve sector 34. It is preferably square in cross-section and is united with the collar portion 113 by suitable connecting bar 112. Its lower end 114 contacts the verical part of the base member for steadiness. See FIG. 4. A boss 118 is also integral therewith. Such boss swings in and out of contact with the inwardly projection part of pin 42. Finally a latch lug 116 is inwardly disposed on the carrier member for engagement with latch release 122.

Turning now to a latching or locking system for holding a boat in the storage mode, I have provided dual rod supports 126, each projected up from the base member and within the span of the other described dual assemblies. Similarly, a second set of two supports 132 may be positioned within the span of supports 126 as is illustrated in FIG. 5, a rod 124 is rotatably mounted in aligned orifices through all the supports as illustrated. Midway on the rod is a foot-pedal or treadle 128 to turn the rod. At each end of the rod is secured a latching portion 120. As shown in FIG. 3 such portion is preferably an ellipsoid plate with recess 122. A post 130 may be positioned under the pedal to limit the distance it can travel. Also, a spring (not illustrated) may be included to automatically insure engagement of the latch.

Figure 21:
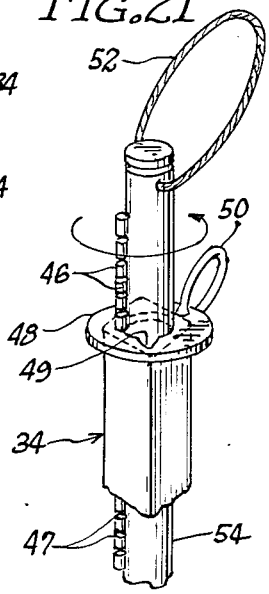
FIG. 21 is a perspective view of vertical adjustable portion of such davit.

Slideability placed within sleeve sector 34 is a vertical arm 54 of L-shaped davit assembly 28. A novel verical series of serrations 46 may be provided along this tubular part for controlling the distance the davit extends into the water. Lock ring 48 of FIG. 11 fits around the arm and may be slid along it when recess 49 is aligned with the serrations. The ring rests on the upper end of sector 34. When so aligned the lower right angled horizontal arm 58 may be extended into the water to a desired depth. Whereupon the operator simply grasps tab 50 of the ring and rotates it partially whereby it now occupies a space 47. Once set for a particular dock, it need not be changed. See FIG. 1. There may be a rope loop 52 at the upper end of the arm to facilitate handling. The serrated strips as a projection has an additional function. As shown in FIG. 21, the projection fits snugly into a corner of the squared sleeve 34 to prevent undesired rotation of arms. However for storage or non-use the arm may be lifted past the projection and rotated, as in FIG. 18. Additional and optional features include a soft bumper 56 on the vertical arm and more extensive material 61 on the horizontal arm, all for boat protection. Uni-cellular styrofoam is desirable for this purpose.

To accommodate boats of different widths the horizontal arm may have telescopic inner section 60. To insure a snug fit frictional drag may be created by fitting material, preferably velcro 59, between the sections. At the outer end, cap 62 fits snugly for attached draw straps on ropes, as described next in order.

As a protracted harness member, draw rope or strap 66 is secured to cap 62 by suitable fastener 64 at its lower end. It's upper end 84 is connected to the cross bar of the lever member by friction band 82. All fit within reel guide 76 as slot 86 through which the strap passes. A collar 94 may be provided outside the reel arrangement to prevent lateral movement.

The reels are fixed with and rotate with control sleeve 78. This novel component is divided into two like sections 88 and 90.

Figure 16:
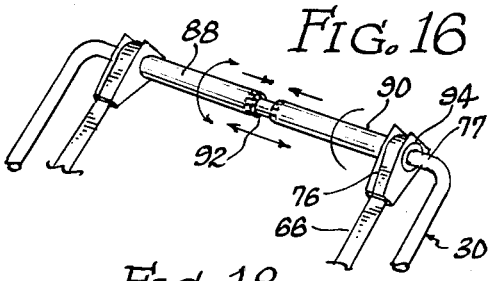
FIG. 16 is a perspective view of handle portion showing sections in slightly separated position.
Figure 17:
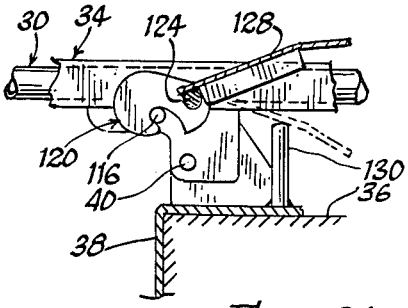
FIG. 17 is a detail of launching arrangement.

These items circumvent the cross bar 30 as best seen in detail in FIG. 6. They have desired frictional drag by resistence material, preferably dual bands of velcro 80 at the outer ends (one is illustrated in FIG. 6), and like dual 96 (both ilustrated in FIG. 7) near the center of control sleeve 78. As another novel feature, the two sectors may be brought together for rotation as a unit. Mating serrations 92 permit the unison or separate manual rotation of these dual sleeve sections. See FIG. 16.

Finally an inner harness member 68, again of strap or rope construction, is provided. It too is attached to cap 62 to extend over the outside of the boat. It is attached to adjustable strap 70 which in turn is connected by strap 72 on an eyelet 74 on item 34.

To describe operation of the invention, reference is to the initial position of boat 32 in the novel device 26 of FIG. 1. The boat may be any of many various types, preferably one of ten feet in length or less. To store the boat, it is first positioned evenly on the underwater area or davits which extends outward from the conventional dock. Prior thereto the base member has been secured along the edge of the dock with its angled section extending down a side thereof. Also, by rings 248, dual vertical arms 54 have been extended and set to proper depth for particular boat and distance from dock to water. With the two sets of dual harnesses over the boat, as illustrated, sleeve 78 is manually grasped and brought to near the horizontal surface of the dock as indicated by the arrows of FIG. 1. The boat has gone from the phantom sketch thereof of FIG. 14, then 15 to rest on its edge above the dock. Slack in the protracted harness, created by the operation, is taken up by manually rotating sleeve 78. Initially dual sections thereof, items 88 and 90 are separated and rotated individually until the straps both have the same tightness or tension. When both are equally taut, the sections are united for rotation in unison. This step is required because the stern and bow of boats are of different dimensions and the straps spanning them must thereby vary in length. Inner harness 68 is drawn taut to help hold the boat in position.

When the boat reaches it position of FIG. 14, it remains there because the latch system has automatically dropped into the locked position. Latch lug 116 of FIG. 3, being an integral part of carrier 113, has moved under the recess 122 of portion 120. Portion 120 drops down to cinch the lug either by the gravity of its own weight or, as an option, by spring means (not shown). See phantom lines of FIG. 3. The carrier, being held horizontally, the davit sliding therein are likewise held. The lever action of raising the boat having been accomplished, lever 30 is returned to its upright vertical position. The operator's hands, being on the cross pieces of the lever, rotate the control sleeve 78 with sectors engaged for unison action. This takes up the slack in the harness as the lever is raised to its vertical position. As shown in FIG. 4 slight recess 102 at top of mounting bracket 44 and butting surface 104 thereon holds the lever steady for winding and unwinding the harness. In the upright position the boat may be stored in this neat out-of-the-way position indefinitely.

Supposing, later, the boat is to be launched. In such event the sailor simply again grasp the unified control sleeve 78 with his or her hands, and, with a foot, depresses pedal 128. This causes rod 124 to rotate partially lifting the dual latches at the ends of the rods. As in FIG. 3, the lug 116 now freely escapes the recess in the latch and it and the parts to which it is fixed pivot on shaft 40 and descend towards the water. Specifically, the sleeve carrier containing the davits drops, as does the boat resting thereon. The sailor's hands control the speed with which the control sleeve 78 is rotated by the unwinding harness as it too is being pulled downwardly towards the water. This controlled launch is a feature of the invention. When the boat floats, the line straps may be slackened and the boat becomes free of the rig.

Figure 18:
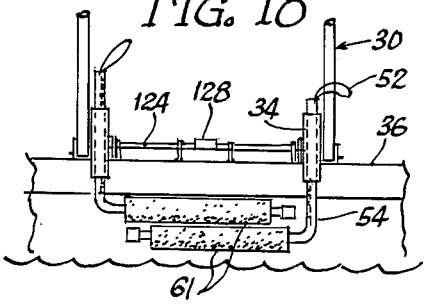
FIG. 18 is a side elevation of the device from the water side showing the under water davits turned-inwardly along the dock, as when not in use.
Figure 19:
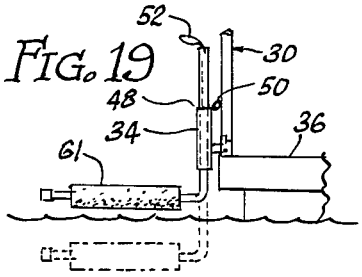
FIG. 19 is an end view thereof showing davits in position for use above the water and a phantom of position in water.
Figure 20:
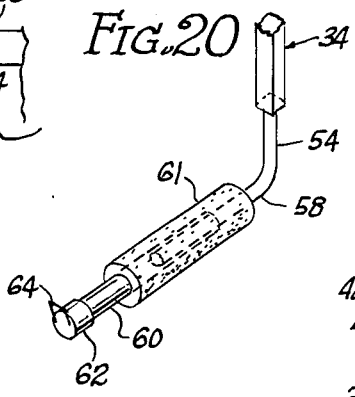
FIG. 20 is a perspective view of one of the dual davits.

For extended non-use, the davits may be lifted from the water as in FIG. 19 and turned inwardly, at different depths, for parallel alignment along the edge of the dock as can be seen in FIG. 18.

Having described my invention, which skilled persons may modify without departing from the scope thereof, I claim:

1. A device for lifting, storing and launching small boats into and out of the water alongside a conventional dock or pier comprising: A base member suitable for being secured to a conventional dry dock; tiltable inverted U-shaped lever means carrying an adjustable L-shaped davit means on each leg of said lever means for supporting a boat pivotally mounted on said base member, and an integrated carrier member operatively connected to the lever means and the davit means whereby force on the lever means will cuse a boat supported by the davit means to be lifted from the water and be retained on its side in a vertical position out of the water above and at the edge of the dock.

2. The claim according to claim 1 wherein a latching means on said base member is engagable with the integrated carrier member whereby the lever means may be returned to a vertical position while the davit means remains in a fixed position out of the water.

3. The claim according to claim 1 wherein a harness means connecting the davit means to the carrier means and to the lever means to help secure the boat on the davit means.

4. The claim according to claim 3 wherein a manual control means on said lever means is provided for releasing the harness at a manually controlled variable rate of speed whereby the davit means, with said boat, may be returned to the water as fast as desired.

5. The claim according to claim 1 wherein the vertical legs of said davit means can be moved vertically according to the distance from the top of the dock to the water plus the draft of the boat and locked in such position, the horizontal legs of said davit means can be adjusted horizontally to accommodate the mean of the boat.

6. The claim according to claim 5 wherein the vertical and horizontal legs of said davit means are covered with resilient cylindrical members to cushion the bottom and sides of the boat while on said davit means.

7. A base member suitable for being secured to a conventional dry dock; tiltable davit means for supporting a boat pivotally mounted thereon; a lever means also pivotally mounted on the base member; an integrated carrier member operatively connected to the lever means and the davit means whereby force on the lever means will cause a boat supported by the davit means to be lifted from the water and be retained on its side at the edge of the dock; a latching means on said base member is engagable with the integrated carrier member whereby the lever means may be returned to a vertical position while the davit means remains in a fixed position out of the water; a harness means connected to the davit means and to the carrier means and to the lever means to help secure the boat on the davit means; and a control means on said lever means is provided for releasing the harness at a variable rate of speed whereby the davit means, with said boat, may be returned to the water as fast as desired.

* * * * *